United States Patent [19]

Eckhardt et al.

[11] Patent Number: 5,040,275

[45] Date of Patent: Aug. 20, 1991

[54] STRIP MATERIAL USED FOR FORMING FASTENERS

[75] Inventors: Carey J. Eckhardt, Moundsview; James J. Kobe, Newport; Susan K. Nestegard, Woodbury; Cathleen M. Arsenault, St. Paul; Vern E. Radewald, Minneapolis, all of Minn.

[73] Assignee: Minnesota Mining and Manufacturing Company, Saint Paul, Minn.

[21] Appl. No.: 531,868

[22] Filed: Jun. 1, 1990

[51] Int. Cl.[5] ..... A44B 18/00

[52] U.S. Cl. ..... 24/447; 24/442

[58] Field of Search ..... 24/442, 452, 444, 447, 24/448, 446; 428/100

[56] References Cited

U.S. PATENT DOCUMENTS

| | | | |
|---|---|---|---|
| 3,408,705 | 11/1968 | Kayser et al. | 24/452 |
| 4,216,257 | 8/1980 | Schams et al. . | |
| 4,290,174 | 9/1981 | Kalleberg . | |
| 4,322,875 | 4/1982 | Brown et al. . | |
| 4,920,617 | 5/1990 | Higashinaka | 24/442 |

FOREIGN PATENT DOCUMENTS

| | | | |
|---|---|---|---|
| 1102627 | 2/1968 | United Kingdom | 24/452 |

*Primary Examiner*—James R. Brittain

*Attorney, Agent, or Firm*—Gary L. Griswold; Walter N. Kirn; William L. Huebsch

[57] ABSTRACT

A strip material from which portions may be severed and used together as a releasably engageable fastener. The strip material comprises a bonding layer in which are embedded a plurality of U-shaped monofilaments. Each U-shaped monofilament includes two headed stem portions adapted to engage the headed stem portions of another portion of the strip material. The U-shaped monofilaments are disposed in generally straight rows longitudinally of the strip material with a percentage of the center to center spacing dimensions between adjacent longitudinal rows being less than a maximum dimension equal to the diameter of the heads plus the diameter of the stems so that slippage of heads longitudinally of the strip material between these closely spaced rows will be restricted, and with the center to center spacing dimension between the rest of the adjacent rows being greater than the maximum dimension and being selected to help provide a desired level of engagement and disengagement forces between the portions. The U-shaped monofilmanets are also disposed in zig-zag rows transverse of the strip material and are spaced and shaped so that slippage of heads transversely of the strip material between the zig-zag rows will also be restricted and to help provide a desired level of engagement and disengagement forces between the portions. Thus, upon engagement the rows of headed stem portions of one portion of the strip material cannot readily slip between the rows of headed stem portions on another portion of the strip material.

7 Claims, 1 Drawing Sheet

STRIP MATERIAL USED FOR FORMING FASTENERS

BACKGROUND OF THE INVENTION

This invention relates to strip materials that have headed projections which will releasably engage so that two severed portions of the strip materials will provide a releasable fastener between different objects.

U.S Pat. No. 4,290,174 describes such a strip material which comprises a flexible polymeric bonding layer; a multiplicity of flexible, resilient, generally U-shaped monofilaments of polymeric material, each including a central bight portion embedded in the bonding layer in a rectangular array, two stem portions extending from the bight portion and projecting generally normal to a surface of the bonding layer; and enlarged, generally circular heads at the distal ends of the stem portions. Each of the heads has an outer cam surface adapted for engagement with the cam surfaces of heads along a different portion of the strip material to produce deflection of the stem portions and movement of the heads on the stem portions past each other to releasably engage the portions, and has a latching surface opposite the cam surface, which latching surface is generally planar, extends at generally a right angle radially from its supporting stem portion, and is adapted to engage similar latching surfaces on the heads of the other portion when the portions are engaged.

While fasteners made from two portions cut from the strip material described in U.S. Pat. No. 4,290,174 have provided many advantages over other known fasteners for many applications, that strip material can not provide both a moderate level of engagement and disengagement forces between portions of the strip material while restricting unwanted relative movement between the engaged portions in response to the application of forces applied to the two fastener portions in a direction parallel to their backing layers and to the rows. If the stem portions and heads are so closely spaced that the rows of headed projections on one portion can not slide between the rows of headed projections on the other portion under these conditions, the force required to engage and disengage the portions is so high that a fastener made using the portions is not useful for many purposes. If the stem portions and heads are spaced sufficiently that the force required to engage and disengage the portions is at the moderate and often more useful level, the rows of headed projections on one portion can slide between the rows of headed projections on the other portion, thereby allowing the portions to become partially or totally disengaged. U.S Pat. No. 4,290,174 describes reducing this problem by (1) varying the spacings of the stems along the rows extending longitudinally of the strip so that at least when the rows of two articles with such varied spacing are engaged at right angles to each other, greater separating and shear strengths will be developed, or (2) disposing the rows of U-shaped filaments so that their stems are not aligned normal to or parallel with the edges of the strip so that when a user engages two portions of the strip with their edges parallel (as he would normally be expected to do), the rows on the articles will cross each other to develop the maximum strength in the fastener both in tension and shear, or (3) shifting successive rows of U-shaped filaments slightly in a direction transverse to the strip so that the stems of successive rows will not be aligned and thus will not permit shearing longitudinally or transversely of the strip.

While these techniques would help reduce the problem, they do not preclude slippage between the rows for all possible orientations of the rows. Additionally, the mechanism for accomplishing the second and particularly the third technique mentioned complicate the device on which the strip material is produced more than might otherwise be desired, particularly when wide widths (i.e., 6 inch or greater widths) of the strip material are made.

Thus, the solution to the problem described in U.S. Pat. No. 4,322,875 was developed, which involves utilizing two different strip materials with rectangular arrays of headed stems, each of which strip materials has stem portions that are about equally spaced in each direction to provide numbers of stem portions per unit length along the surface of its bonding layer in each direction that are different from and not a multiple of or evenly divisible by the number of stem portions per unit length on the other strip material in either direction (e.g., 20 stem portions per inch in each direction on one strip material, and 12 stem portions per inch in one direction and 14 stem portions per inch in the other direction on the other strip material). With this construction, a desired useful level of engagement and disengagement forces can be provided for portions of the strip materials and when portions of the different two strip materials are engaged with rows aligned, certain of the stem portions will always interfere with each other to restrict relative movement between the portions of the strip materials in a direction parallel to their bonding layers. While this solution is reasonably effective and has been used commercially, it requires manufacturing and stocking two different strip materials.

SUMMARY OF THE INVENTION

According to the present invention there is provided a single strip material generally of the type described above but with the headed stems arrayed in a pattern so that two portions of the strip material when used together will form a fastener that can have a desired useful level of engagement and disengagement forces and, when engaged, will restrict slippage when forces are applied in a direction parallel to the backing layers of the portions regardless of the orientation in which the portions are attached together.

The strip material according to the present invention, like the strip material described in U.S. Pat. No. 4,290,174, comprises a polymeric bonding layer; a multiplicity of flexible, resilient, generally U-shaped monofilaments each including a central bight portion embedded in the bonding layer and two stem portions extending from the opposite ends of the bight portion and projecting generally normal to an exposed major surface of the bonding layer; and enlarged, generally circular heads at the ends of the stem portions opposite the bight portion, each of the heads having a cam surface opposite its supporting stem portion, and having a latching surface opposite the cam surface. The bight portions of the U-shaped monofilaments are disposed in an array that affords movement of the heads of portions of the strip material past and, into releasable engagement with each other.

Unlike the strip material described in U.S. Pat. No. 4,290,174, however, the strip material according to the present invention provides both a desired level of engagement and disengagement forces between portions of the strip material while restricting relative movement between the engaged portions in directions parallel to the bonding layers. This occurs because:

(1) the bight portions are disposed in generally straight longitudinal rows parallel to the first direction with about 10 to 90 percent (and preferably about 30 to 70 percent) of the adjacent longitudinal rows being spaced center to center in a direction normal to the first direction by a first dimension that is less than a maximum dimension equal to the diameter of the heads plus the diameter of the stems so that slippage of the heads longitudinally of the strip material between these closely spaced rows will be restricted, and with the rest of the adjacent longitudinal rows being spaced center to center in a direction normal to said first direction by a first spacing dimension that is greater than said first maximum dimension, and (2) the bight portions are disposed in rows transverse to the first direction with the bight portions in each row being disposed in a zig-zag (e.g., sinusoidal) pattern deviating in each direction parallel to the first direction about an imaginary center line normal to the first direction with the deviation in each of the two directions being in the range of one half of the head diameter to one half of the sum of the head diameter plus the stem diameter, and with about 10 to 90 percent (and preferably about 30 to 70 percent) of the center to center distances between the stems along each longitudinal row, including the distances between stems extending from the opposite ends of the bight portions and the distances between the adjacent stems on adjacent bight portions along said longitudinal row, being less than a second maximum dimension equal to the diameter of the heads plus the diameter of the stems plus said deviation so that slippage of the heads transversely of the strip material between the zig-zag rows will also be restricted, with the rest of the center to center distances between the stems along each longitudinal row being spaced by spacing dimensions that are greater than said second maximum dimension, those spacing dimensions being selected in combination with the first spacing dimension to help provide a desired level of engagement and disengagement forces between the portions.

Thus, when portions of the strip material are engaged in any orientation, including with the longitudinal rows parallel, certain of the stem portions and heads will always interfere with each other to restrict said relative movement between the portions of the strip material in directions parallel to the bonding layers.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENT

Figure 1:
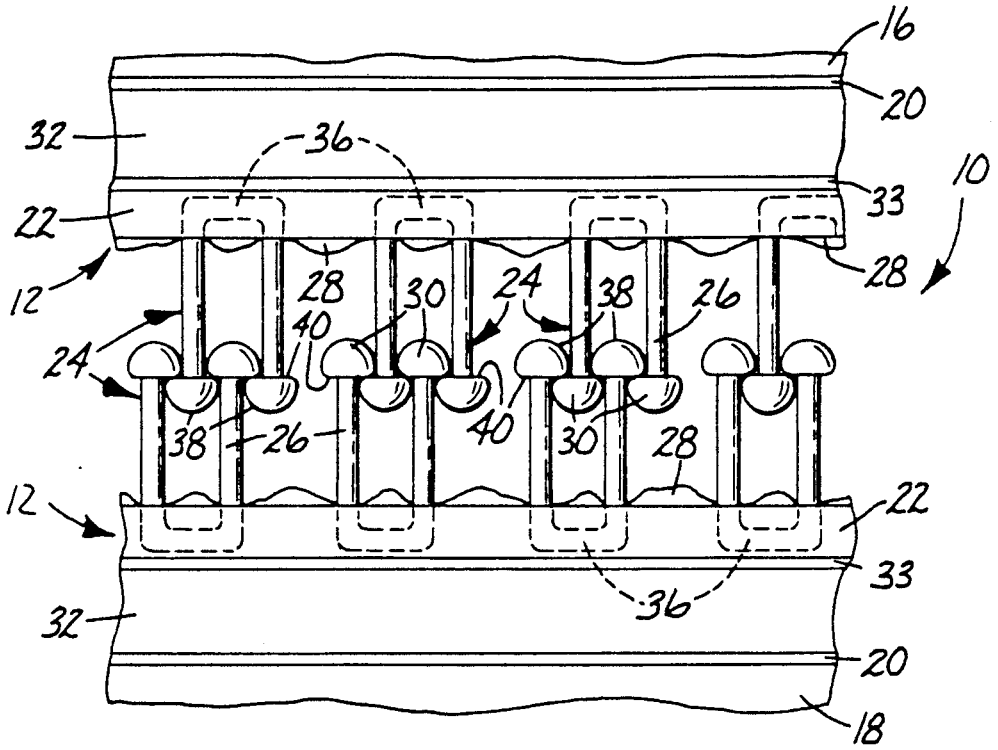
FIG. 1 is a fragmentary edge view of two portions of the strip material according to the present invention shown engaged with each other.
Figure 2:
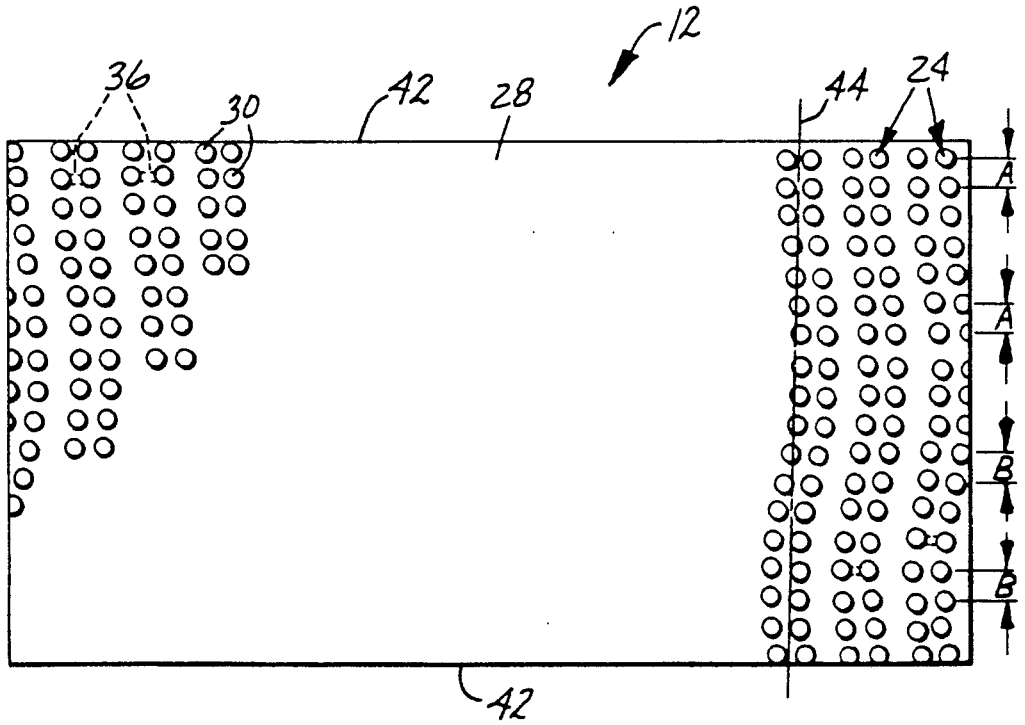
FIG. 2 is an enlarged fragmentary top plan view of the strip material from which the portions shown in FIG. 1 have been taken.

Referring now to the drawing there are shown in FIG. 1 two portions 10 severed from an elongate strip material 12 according to the present invention shown in FIG. 2, which two portions 10 of the strip material 12 have been attached to the surfaces of different objects 16 and 18 by layers of pressure sensitive adhesive 20 and engaged with each other as illustrated in FIG. 1 to fasten the objects 16 and 18 together.

The strip material 12 comprises a bonding layer 22 in which are embedded a plurality of flexible, resilient, generally U-shaped monofilaments 24. The monofilaments 24 have stem portions 26 that project from a major surface 28 of the bonding layer 22 and have heads 30 at their distal ends. The bonding layer 22 and the method by which the monofilaments 24 are embedded in the bonding layer 22 are described in greater detail in U.S. Pat. No. 4,290,174, the content whereof is incorporated herein by reference. Also, the strip material 12 includes a layer of low density foam 32 and the layer of pressure-sensitive adhesive 20 which is a soft tacky pressure-sensitive adhesive, which layers 32 and 20 help in securely attaching the strip material 12 to an object as is described in greater detail in U.S. Pat. No. 4,216,257 the content whereof is also incorporated herein by reference. The layer of foam 32 is adhered to the surface of the bonding layer 22 opposite the surface 28 by a layer of adhesive 33 which may be of the same material as the layer of adhesive 20.

The bonding layer 22 in which the U-shaped monofilaments 24 are embedded is of a uniform non-fibrous, non-oriented polymeric material (e.g., Eastman polyallomer 5321E, available from Eastman Chemical Co., Longview Tex.) and has a predetermined thickness adapted to receive bight portions 36 of the U-shaped monofilaments 24. The U-shaped monofilaments are formed of a longitudinally oriented polymeric material (e.g., polypropylene monofilaments available from Shakespeare Monofilament Co., Columbia, S.C.). The stem portions 26 of each monofilament 24 are of essentially the same length, project at generally a right angle from the surface 28 of the bonding layer 22 and extend from the ends of the embedded bight portion 36 of the monofilament 24. The heads 30 have arcuate, generally semi-spherical cam surfaces 38 opposite the bonding layer 22, so that the cam surfaces 38 of the heads 30 on one portion 10 severed from the strip material 12 are adapted for engagement with the cam surfaces 38 on the heads 30 of the other portion 10 severed from the strip material 12 to produce the necessary side deflection of the stem portions 26 upon movement of the heads 30 toward each other with the bonding layers 22 generally parallel so that the heads 30 may pass to engage the portions 10 of the strip material 12 in the manner illustrated in FIG. 1. Also, the heads 30 on each portion 10 of the strip material 12 each have a generally planar latching surface 40 extending radially outwardly of its supporting stem portion 26, which latching surface 40 is adapted to engage the latching surface 40 on one or more of the heads 30 of the other strip material 12 to retain the heads 30 in engagement until a predetermined force is applied to separate them.

The strip material 12 according to the present invention provides a desired level of engagement and disengagement forces between the portions 10 of the strip material 12 while restricting relative movement between the engaged portions 10 in directions parallel to the bonding layers 22. This occurs, as can be seen in FIG. 2, because (1) the bight portions 36 are disposed in generally straight longitudinal rows parallel to a first direction parallel to the opposite edges 42 of the elongate strip 12 with about 10 to 50 percent (and preferably 30 to 70 percent) of the adjacent longitudinal rows being spaced center to center in a direction normal to the first direction by a spacing dimension A that is less than a first maximum dimension equal to the diameter of the heads 30 plus the diameter of the stems 26 so that when the portions 10 are engaged with their edges 42 parallel, slippage of heads 30 longitudinally of the strip material 12 between these closely spaced rows will be restricted; and with the rest of the adjacent longitudinal rows being spaced center to center in a direction normal to the first direction by a spacing dimensions B that is greater than that maximum dimension and that is selected to help provide a desired level of engagement and disengagement forces between the portions 10; and because (2) the bight portions 36 are disposed in rows transverse to the first direction or edges 42 with the bight portions 36 in each transverse row being disposed in a zig-zag or sinusoidal pattern deviating in each direction parallel to the first direction or edges 42 about an imaginary center line normal to the edges 42 or first direction (which center line is illustrated for one transverse row and is identified with the reference numeral 44) with the deviation in each of the two directions being in the range of one half of the diameter of the heads 30 to one half of the sum of the diameter of the heads 30 plus the diameter of the stems 26; and with about 10 to 90 percent of the center to center distances between the stems 26 along each longitudinal row, including the distances between stems 26 extending from the opposite ends of the bight portions 36 and the distances between the adjacent stems 26 on adjacent bight portions 36 along that longitudinal row, being less than a second maximum dimension equal to the diameter of the heads 30 plus the diameter of the stems 26 plus said deviation so that slippage of the heads 30 transversely of the strip material 12 between the zig-zag rows will also be restricted, with the rest of the center to center distances between the stems 26 along each longitudinal row being spaced by spacing dimensions that are greater than said second maximum dimension, those spacing dimensions being selected in combination with said first spacing dimension to help provide a desired level of engagement and disengagement forces between the portions 10.

Thus when portions 10 of the strip material 12 are engaged in any orientation, including with the longitudinal and transverse rows on the portions 10 parallel, certain of the stem portions 26 and heads 30 on the two portions 10 will always interfere with each other to restrict relative movement between the portions 10 of the strip material 12 in any direction parallel to their bonding layers 22.

The strip material 12 can be made using the method described with reference to FIG. 6 in U.S. Pat. No. 4,290,174 modified to provide striking bars 39 corresponding in shape to the zig-zag or sinusoidal pattern of the transverse rows to be formed, and to provide guides 37 that are positioned very close to the path of travel of the striking bars 39 and are spaced to overcome a tendency for the monofilaments 36 to slide transversely along the zig-zag or sinusoidal striking bars 39 to the portions thereof closest to the guides 37.

The closely spaced adjacent longitudinal rows that are spaced by the spacing dimension A that is less than a maximum dimension equal to the diameter of the heads 30 plus the diameter of the stems 26 are preferably evenly interspersed with the rest of the adjacent longitudinal rows that are spaced by the spacing dimensions B that is greater than that maximum dimension and that is selected to help provide a desired level of engagement and disengagement forces between the portions 10. When the strip material 12 is made using the method indicated in the preceding paragraph, it is easiest to make the strip material with uniform dimensions between stems 26 extending from the opposite ends of the bight portions 36, and with uniform dimensions between the adjacent stems 26 on adjacent bight portions 36 along that longitudinal rows, with one of those uniform dimensions being greater than the second maximum dimension and the other uniform dimension being less than the second maximum dimension; and then to make any other needed adjustment in the level of engagement and disengagement forces for the portions 10 by changing the amount of rows spaced by the spacing dimensions A and B and the spacing dimensions between the rows and stems.

The level of engagement and disengagement forces for the portions 10 produced for each orientation of the stems 26 in accordance with the guidelines set forth above is conveniently estimated by computer modeling in which a layout drawing of the stem positions of two existing fastener portions engaged with each other is made, the amount of engagement of the heads with each other on those engaged portions is determined from visually inspecting the drawing, and that engagement is related to the known force of engagement and disengagement exhibited by the existing fastener portions using finite element analysis techniques. The computer is then caused to draw fastener portions with different stem spacing dimensions, which drawings are overlaid to determine the amount of engagement of the heads. Based on that amount of engagement compared to the amount of engagement on the existing fastener samples, an estimate is made (which has proved to be reasonably accurate) of the level of engagement and disengagement forces that will be produced by the new fastener portions. Thus the amount of experimentation to produce a strip material that will produce desired engagement and disengagement characteristics is greatly reduced.

As a specific non-limiting example, when the strip material 12 has stem portions 26 0.381 millimeter (0.015 inch) in diameter projecting 2.286 millimeter (0.09 inch) and heads 30 0.991 millimeter (0.039 inch) in diameter, and has 50 percent (i.e., 9 out of 18) of the adjacent longitudinal rows spaced center to center in a direction normal to the first direction by a spacing dimension A of 1.27 millimeter (0.050 inch) and the rest of the adjacent longitudinal rows spaced center to center in a direction normal to the first direction by a spacing dimensions B of 1.55 millimeter (0.061 inch); and the bight portions 36 are disposed in sinusoidal rows transverse to the first direction or edges 42 with each complete period of the sinusoidal pattern including 13.5 rows and the bight portions 36 in each transverse row having a maximum deviation in each direction parallel to the first direction or edges 42 about the imaginary center line 44 of 0.584 millimeter (0.023 inch), the center to center distance between the stems 26 extending from the opposite ends of each bight portion 36 along each of the longitudinal rows being about 1.52 millimeter (0.060 inch), and the distance between the adjacent stems 26 on adjacent bight 36 portions along each of the longitudinal rows being about 2.03 millimeters (0.080 inch); two portions 10 of the strip material 12 will securely mate with each other and will not slip in directions parallel with their bonding layers 22, while providing an engagement force of about 71 newtons (16 pounds), and a disengagement force of about 156 newtons (35 pounds) for about 645 square millimeters (1 square inch) engagement of the portions 10. Sample portions of this example strip material were cut that were each 2.5 centimeters wide by 15 centimeters long, some with the elongate rows of stems 26 running longitudinally of the sample portion, and some with the elongate rows of stems 26 running transverse of the sample portion. Pairs of the sample portions then had 2.5 centimeter lengths adjacent one of their ends overlapped and the headed stems thereon engaged with each other so that their opposite end portions extending in opposite directions away from each other. Those opposite end portions were clamped in the jaws of a model 1122 "Instron" brand tensile tester, commercially available from Instron, Canton, Mass., and the jaws of the tensile tester were separated at a rate of 30.5 centimeters (12 inches) per minute to determine the maximum shear force needed to cause relative movement between the portions 10 of the strip material 12 in directions parallel to their bonding layers 22. When sample portions were selected so that the elongate rows of stems were parallel to each other and parallel to the direction that force was applied by the tensile tester, about 17.9 pounds per square inch of shear strength was needed to cause such relative movement. When sample portions were selected so that the elongate rows of stems were parallel to each other and at right angles to the direction that force was applied by the tensile tester, about 13.6 pounds per square inch of shear strength was needed to cause such relative movement. When sample portions were selected so that the elongate rows of stems on the different sample portions were disposed at right angles to each other and the direction that force was applied by the tensile tester was parallel to the rows of stems on one of the sample portions, about 20.2 pounds per square inch of shear strength was needed to cause such relative movement.

The present invention has now been described with reference to one embodiment thereof. It will be apparent to those skilled in the art that many changes can be made in the embodiment described without departing from the scope of the present invention. Instead of the structure for the strip material 12 described above, the strip material may be made in accordance with the teachings of a patent application filled concurrently herewith wherein the combination of the bonding layer, the monofilaments, a layer of resiliently elastic material that replaces the layer of foam 32, and pressure sensitive adhesive means for adhering the strip material to a substrate are highly transparent (i.e., has an opacity of less than about 25%) when viewed from an angle at which the exposed major surface of the bonding layer can be seen after the strip material is adhered to a substrate so that the color of the substrate will be fairly clearly seen through the strip material, which causes the presence of a fastener portion from the strip material to be far less noticeable and objectionable than it can be when it is a different color than the substrate, and produces this effect without the necessity of matching the color of the fastener portion to the color of the substrate. Thus the scope of the present invention should not be limited to the structure described in this application, but only by structures described by the language of the claims and the equivalents of those structures.

We claim:

1. A strip material which is elongate in a first direction from which strip material portions may be severed to form portions of a fastener, said strip material comprising a polymeric bonding layer; and a multiplicity of flexible, resilient, generally U-shaped monofilaments, each monofilament including a central elongate bight portion embedded in the bonding layer and disposed generally parallel to said first direction, two generally cylindrical stem portions having about the same diameters extending from the opposite ends of said bight portion and projecting generally normal to an exposed major surface of the bonding layer, and enlarged, generally circular heads at the ends of said stem portions opposite said bight portion, each of the heads having about the same diameter, a cam surface opposite its supporting stem portion adapted for engagement with the cam surfaces of other heads along the strip material to produce deflection of the stem portions and to afford movement of the heads on the stem portions past each other, and having a latching surface opposite said cam surface adapted to engage a similar latching surface on another head; the bight portions of said U-shaped monofilaments being disposed in an array that affords movement of the heads of portions of the strip material past and, into releasable engagement with each other, and said strip material providing a desired level of engagement between the portions of the strip material while restricting relative movement between the engaged portions in directions parallel to said bonding layers in that said bight portions are disposed in generally straight longitudinal rows parallel to said first direction with about 10 to 90 percent of the adjacent longitudinal rows being spaced center to center in a direction normal to said first direction by a dimension that is less than a first maximum dimension equal to the diameter of the heads plus the diameter of the stems so that slippage of said heads longitudinally of the strip material between these closely spaced rows will be restricted, and with the rest of the adjacent longitudinal rows being spaced center to center in a direction normal to said first direction by a first spacing dimension that is greater than said first maximum dimension, and said bight portions are disposed in rows transverse to said first direction with the bight portions in each row being disposed in a zig-zag pattern deviating in each direction parallel to said first direction about an imaginary center line normal to said first direction with the deviation in each of said two directions being in the range of one half of said head diameter to one half of the sum of said head diameter plus said stem diameter, and with about 10 to 90 percent of the center to center distances between the stems along each longitudinal row, including the distances between the stems extending from the opposite ends of the bight portions and the distances between the adjacent stems on adjacent bight portions along the longitudinal row, being less than a second maximum dimension equal to the diameter of the heads plus the diameter of the stems plus said deviation so that slippage of said heads transversely of the strip material between the zig-zag rows will also be restricted, with the rest of the center to center distances between the stems along the longitudinal row being spaced by spacing dimensions that are greater than said second maximum dimension, said spacing dimensions and said first spacing dimension being selected to help provide a desired level of engagement and disengagement forces between the portions, whereby when portions of the strip material are engaged in any orientation, including with the longitudinal rows parallel, certain of the stem portions and heads will always interfere with each other to restrict said relative movement between the portions of the strip material in directions parallel to said bonding layers.

2. A strip material according to claim 1 wherein said zig-zag pattern is sinusoidal.

3. A strip material according to claim 1 wherein about 30 to 70 percent of the adjacent longitudinal rows are spaced center to center in a direction normal to said first direction by a dimension that is less than a said first maximum dimension, and about 30 to 70 percent of the center to center distances between the stems extending from the opposite ends of the bight portions and the distances between the adjacent stems on adjacent bight portions along said longitudinal rows are less than said second maximum dimension.

4. A strip material according to claim 1 wherein about 50 percent of the adjacent longitudinal rows are spaced center to center in a direction normal to said first direction by a dimension that is less than a said first maximum dimension, and about 50 percent of the center to center distances between the stems extending from the opposite ends of the bight portions and the distances between the adjacent stems on adjacent bight portions along said longitudinal rows are less than said second maximum dimension.

5. A strip material according to claim 1 wherein said stem diameters are in the range of 0.076 to 1.27 millimeters (0.003 to 0.050 inch), and said head diameters are in the range of 0.152 to 3.81 millimeters (0.006 to 0.150 inch).

6. A strip material according to claim 1 wherein said stem diameters are in the range of 0.305 to 0.457 millimeters (0.012 to 0.018 inch), and said head diameters are in the range of 0.610 to 1.372 millimeters (0.024 to 0.054 inch).

7. A strip material according to claim 1 wherein said stem diameters are about 0.038 millimeters (0.015 inch), and said head diameters are about 1.016 millimeters (0.040 inch).

* * * * *